US005575130A

United States Patent [19]

Chiodo

[11] Patent Number: 5,575,130

[45] **Date of Patent: *Nov. 19, 1996**

[54] ANCHOR DEVICE

[76] Inventor: Daniel J. Chiodo, 12399 SW. 53rd St., Suite 104, Cooper City, Fla. 33330

[ * ] Notice: The term of this patent shall not extend beyond the expiration date of Pat. No. 5,467,569.

[21] Appl. No.: 552,105

[22] Filed: Nov. 2, 1995

Related U.S. Application Data

[63] Continuation-in-part of Ser. No. 269,747, Jul. 1, 1994, Pat. No. 5,467,569.

[51] Int. Cl.[6] ..... E04B 1/38

[52] U.S. Cl. ..... 52/713; 52/295; 52/698; 52/297

[58] Field of Search ..... 52/295, 297, 698, 52/713

[56] References Cited

U.S. PATENT DOCUMENTS

| | | | |
|---|---|---|---|
| 1,423,991 | 7/1922 | Brooks . | |
| 2,013,101 | 9/1935 | Inglee | 72/101 |
| 2,182,579 | 12/1939 | Bolton et al. | 72/101 |
| 2,191,979 | 2/1940 | Bierbach | 72/101 |
| 2,383,544 | 8/1945 | Guimont | 72/77 |
| 3,413,773 | 12/1968 | Fitzgerald | 52/713 |
| 3,422,585 | 1/1969 | Dismukes | 52/295 X |
| 3,750,360 | 8/1973 | Kingston | 52/714 |
| 3,963,210 | 6/1976 | Macklin | 249/210 |
| 3,998,026 | 12/1976 | Allen | 52/714 |
| 4,096,677 | 6/1978 | Gilb | 52/297 |
| 4,199,908 | 4/1980 | Teeters | 52/295 |
| 4,329,826 | 5/1982 | Flogaus et al. | 52/712 |
| 4,387,543 | 6/1983 | Tschan et al. | 52/295 |
| 4,527,375 | 7/1985 | Braginetz | 52/712 |
| 4,875,319 | 10/1989 | Hohmann | 52/383 |
| 4,910,934 | 3/1990 | Hennings | 52/293 |
| 4,924,648 | 5/1990 | Gilb et al. | 52/297 |
| 4,995,206 | 2/1991 | Colonias et al. | 52/297 |
| 5,307,603 | 5/1994 | Chiodo | 52/698 |
| 5,375,384 | 12/1994 | Wolfson | 52/295 |
| 5,467,569 | 11/1995 | Chiodo | 52/713 |

OTHER PUBLICATIONS

Simpson Strong–Tie Company, Inc. Catalog C–95H–1 Jan. 1, 1995, pp. 22 through 24.

*Primary Examiner*—Carl D. Friedman
*Assistant Examiner*—Beth Aubrey
*Attorney, Agent, or Firm*—Oltman Flynn & Kubler

[57] ABSTRACT

An anchoring apparatus for securing a truss member to a concrete structural member includes a U-shaped member including an elongate plate bent end to end to form a curved portion and two leg portions, an abutment plate including a pair of spaced apart, parallel slots, so that when the apparatus is to be assembled, the leg portions of the U-shaped member are fitted through the parallel slots to protrude through the abutment plate, and a structure for anchoring the abutment plate to the U-shaped member, including tabs cut and bent out of the U-shaped member and oriented generally toward the curved portion of the U-shaped member, for engaging the abutment plate, so that the abutment plate slots ride along the leg portions and over the tabs, and the tabs block the abutment plate against moving back along the leg portions. The apparatus may alternatively include a substantially U-shaped member including an elongate plate bent end to end in the form of a curved portion and two leg portions, each leg portion including an abutment plate engaging slot, an abutment plate sized to fit between the leg portions and including two abutment plate ends, each abutment plate end including a leg portion engaging structure for anchoring the abutment plate to the U-shaped member.

2 Claims, 2 Drawing Sheets

ANCHOR DEVICE

This application is a continuation-in-part of application Ser. No. 08/269,747, filed on Jul. 1, 1994, now U.S. Pat. No. 5,467,569.

BACKGROUND OF THE INVENTION

1. Field of the Invention

The present invention relates generally to the field of anchoring devices for securing structural building members together, and more specifically to an anchoring device for securing the bottom member of a truss to the top surface of a wall.

The apparatus is assembled from two parts which are easy to manufacture and compact to store separately. For the first embodiment, the first part is a U-shaped member which takes the form of an elongate plate bent end to end at its center into a tight curve with long leg portions. The second part is a separate abutment plate which includes a pair of spaced apart, parallel slots. When the apparatus is to be used, the leg portions of the U-shaped member are fitted through the parallel slots until they protrude through the abutment plate to a length sufficient to retain between them a truss member. Tabs are cut and bent out of the U-shaped member where the leg portions meet the curved portion and are oriented generally toward the curved portion end of the U-shaped member. These tabs act as abutment plate engaging means. The abutment plate slots ride along the leg portions and over the tabs, and the tabs block the abutment movement of the abutment plate back along the leg portions. The curved portion of the U-shaped plate is embedded in the wall concrete when the wall is formed, and it anchors the apparatus to the wall. A truss member is fitted between the two leg portions, and fasteners are inserted through the fastener ports and driven into truss member.

In a second embodiment, the apparatus is generally like the first except that slots rather than tabs are cut into the U-shaped member where the leg portions meet the curved portion. The slots are oriented longitudinally in relation to the leg portions and are positioned to directly oppose each other. The abutment plate is sized from end to end to fit between the leg portions, except that slot engaging T-portions protrude from opposing ends of the abutment plate. The U-shaped member is sufficiently flexible and resilient that the leg portions may be pulled apart to clear the T-portions. The T-portions are then fitted through the corresponding leg portion slots. The abutment plate is rotated one quarter turn to lock the T-portion into engagement with the U-shaped member.

2. Description of the Prior Art

There have long been anchoring devices for securing beams to concrete structural members, and alternatively to perpendicular beams. Concrete anchors have often been large bolts, each bent at a right angle and placed in cement prior to curing. These bolts are typically heavy and expensive, concentrate the anchoring load along a single line, and fail to provide a secure and convenient coupling structure for attachment to a beam.

Gilb, et al., U.S. Pat. No. 4,924,648, issued on May 15, 1990, discloses a standoff timber base connection. Gilb, et al. includes a generally U-shaped member having two spaced apart leg portions, a connected end and an open end. The connected end is embedded in concrete to a certain depth while the concrete is wet. Gilb et al also includes a spacer structure in the form of a rectangular planar top wall with a continuous and perpendicular perimeter side wall, the spacer structure having slots at two ends where the top and side walls meet. The spacer structure slots are fitted over the protruding leg portions of the U-shaped member until the spacer structure rests against the surface of the cured concrete. The leg portions have laterally narrowed leg segments which are removably engaged by so-called "knuckles" to hold the U-shaped member and spacer structure together. A timber member is fitted between the two leg portions and rests on the spacer structure, so that the spacer structure spaces the timber member from the concrete surface by a certain distance. Fasteners are inserted into ports the leg portions and into the timber member. A problem with Gilb, et al., is that the spacer structure is relatively complex to cut and bend out of a piece of sheet metal. Another problem is that no spacing may be desired between a timber member and a concrete member. Yet no provision is made in Gilb et al. for constructing a spacer structure of minimal height which can still engage the leg portions. This would require elimination of the side wall, and the engaging knuckles are bent out of the side wall.

Teeters, U.S. Pat. No. 4,199,908, issued on Apr. 29, 1980, teaches a post base elevator having a structure very similar to that of Gilb, et al. Like Gilb, et al., Teeters includes a U-shaped member and a spacer member. The essential differences are that the Teeters spacer member has a discontinuous perimeter side wall and is connected to the U-shaped member with bolts passing through the side wall and the leg portions. A problem with Teeters is that, as in Gilb et al, no provision is made for constructing a spacer structure of minimal height which can still engage the U-shaped member. If the side wall were reduced to a negligible height, it could not receive the bolts disclosed to connect the spacer structure to the U-shaped member.

Guimont, U.S. Pat. No. 2,383,544, issued Aug. 28, 1945, discloses a foundation block structure including an anchor device. The Guimont anchor device is like that of Teeters except that the spacer structure is omitted. As a result, no fixed depth is clearly marked for embedding the U-shaped member. Another problem is that the wooden member retained by Guimont is held directly against the concrete, so that moisture within the concrete can rot the wood.

Kingston, U.S. Pat. No. 3,750,360, issued on Aug. 7, 1973, teaches a sill plate anchor device. The Kingston device includes two strap members which are bent to interlock at two points and form a triangle. A peak of the triangle is embedded in concrete and the protruding base of the triangle retains a plank flat against the concrete structure surface. A problem with Kingston is that one strap member has a wide three-dimensional shape which is bulky to store. Another problem is that a point of connection between the strap members is at the embedded peak, so that very heavy loading might cause disconnection at this peak and permit the strap members to slide out of the concrete.

Allen, U.S. Pat. No. 3,998,026, issued on Dec. 21, 1976, discloses a device for tying wooden members to masonry and concrete structures. Allen includes a sheet metal strip longitudinally split at its upper end. The split apart portions are bent in opposite directions out of the plane of the metal strip, and their remote ends are bent in a direction parallel with the strip member. The lower end of the strip and the outwardly diverging split apart portions are embedded in concrete, and the remote ends of the split apart portions extend out of the concrete and engage a wooden member positioned flat against the surface of the concrete. A problem with Allen is that the lower end of the strip is virtually useless as an anchor, and the diverging separate portions near the surface of the concrete provide the only significant anchoring strength. Another problem with Allen is that, once again, the wooden member retained by the device is held directly against the concrete surface, so that moisture within the concrete can rot the wood.

Inglee, U.S. Pat. No. 2,013,101, issued on Sep. 3, 1935, teaches a furring clip. Inglee includes a clip structure with a hook for embedding in mortar between bricks. Inglee is complex and is not designed for anchoring a member to a concrete wall.

Hennings, U.S. Pat. No. 4,910,934, issued on Mar. 27, 1990, reveals a unitary blind locking device for prefabricated structure assembly. Hennings includes a substantially H-shaped structure having perforated feet at a lower end for fastening to a support surface. A wooden member is supported on the cross-segment of the H-structure. A problem with Hennings is that it is not intended for embedding into concrete, and if it were, the lower H-structure would not solidly engage the concrete. Another problem is that, once again, Hennings has a wide three-dimensional shape which is bulky to store, and Hennings cannot be disassembled.

There are several patents which, like Hennings, teach an anchoring structure formed as one piece by cutting and bending sheet metal. These include Beirbach, U.S. Pat. No. 2,191,979, issued on Feb. 27, 1940, for a sleeper anchor; and Brooks, U.S. Pat. No. 1,423,991, issued on Jul. 25, 1922, for a screed holder. Both of these structures have a planar abutment portion and anchoring legs bent out from the planar abutment portion in one direction for embedding in concrete and have fastening legs bent in the opposite direction for retaining between them a wooden member. Fasteners are driven through ports in the fastening legs and into the wooden member. A problem with this general design is that the anchoring legs only provide minimal to moderate anchoring strength. Only irregularities in their faces or edges and minimal friction keep them from sliding straight out of the formed concrete. The legs do not hold nearly as well as would an open metal loop in the concrete. Alternatively, Brooks has anchoring legs with openings which might receive concrete, but these openings present a sharp line profile edge to anchor the apparatus, rather than a broad strip face. Another problem with this general design is that the apparatus must remain in its bulky final shape during storage and transport, and these shapes typically do not nest together well.

Bolton, et al., U.S. Pat. No. 2,182,579, issued on Dec. 5, 1939, teaches a flexible supporting connection. Bolton, et al., is much like Beirbach, except that it is formed of two parts bent out of sheet metal, and joined together around a block of rubber to dampen the transmission of sound waves. The problem is once again presented that the apparatus must remain in its bulky final shape during storage and transport, and this shape does not nest together well with others of the same design.

Another general anchor design is revealed in Colonias et al., U.S. Pat. No. 4,995,206, issued on Feb. 26, 1991, for an elevated post base; and in Gilb, U.S. Pat. No. 4,096,677, issued on Jun. 27, 1978. Both disclose a strip of sheet metal cut and bent into a complex U-shaped structure having a curved lower portion for embedding into concrete and a wooden member retaining upper portion including two member fastening legs. A problem with these structures is that the curved lower portion is mostly closed along its sides, adding complexity and expense to the design and limiting the entrance of wet cement within the curved lower portion, and thus minimizing anchoring strength. Another problem with these structures is that, once again, the apparatus must remain in its bulky final shape during storage and transport, and these shapes do not nest together well.

Braginetz, U.S. Pat. No. 4,527,375, issued on Jul. 9, 1985, discloses a deck board anchor bracket. Braginetz is essentially a U-shaped member having a curved portion for wrapping around a first plank and having leg portions split into forks to receive a perpendicular second plank. A problem with Braginetz is that no provision is made for anchoring a plank to a concrete structure.

It is thus an object of the present invention to provide an anchoring apparatus for joining beams to concrete structural members, the apparatus being formed of two parts which can nest against like parts for compact transport and storage.

It is another object of the present invention to provide such an anchoring apparatus which fastens to two faces of the beam for a secure and economical connection.

It is still another object of the present invention to provide such an anchoring apparatus which can be assembled with ease and minimal training, and in minimal time.

It is finally an object of the present invention to provide such an anchoring apparatus which is inexpensive to manufacture because the two apparatus parts are formed from sheet metal and require minimal cutting and minimal bending to take their specified configurations.

SUMMARY OF THE INVENTION

The present invention accomplishes the above-stated objectives, as well as others, as may be determined by a fair reading and interpretation of the entire specification.

An anchoring apparatus is provided for securing a truss member to a concrete structural member, including a substantially U-shaped member including an elongate plate bent end to end to form a curved portion and two leg portions, an abutment plate including a pair of spaced apart, parallel slots, so that when the apparatus is to be assembled, the leg portions of the U-shaped member are fitted through the parallel slots to protrude through the abutment plate for retaining between them the truss member, and a structure for anchoring the abutment plate to the U-shaped member, including tabs cut and bent out of the U-shaped member and oriented generally toward the curved portion of the U-shaped member, for engaging the abutment plate, so that the abutment plate slots ride along the leg portions and over the tabs, and the tabs block the abutment plate against moving back along the leg portions.

An anchoring apparatus is also provided for securing a truss member to a concrete structural member, including a substantially U-shaped member including an elongate plate bent end to end in the form of a curved portion and two leg portions, each leg portion including an abutment plate engaging slot, an abutment plate sized to fit between the leg portions and including two abutment plate ends, each abutment plate end including a leg portion engaging structure for anchoring the abutment plate to the U-shaped member. The leg portion engaging structures preferably each include an abutment plate engaging slot in each leg portion and a substantially T-shaped protrusion at each abutment plate end for insertion into the engaging slots, so that rotating the abutment plate relative to the leg portions interlocks the U-shaped member and the abutment plate. The engaging slots are preferably oriented longitudinally in relation to the leg portions and positioned to directly oppose each other.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
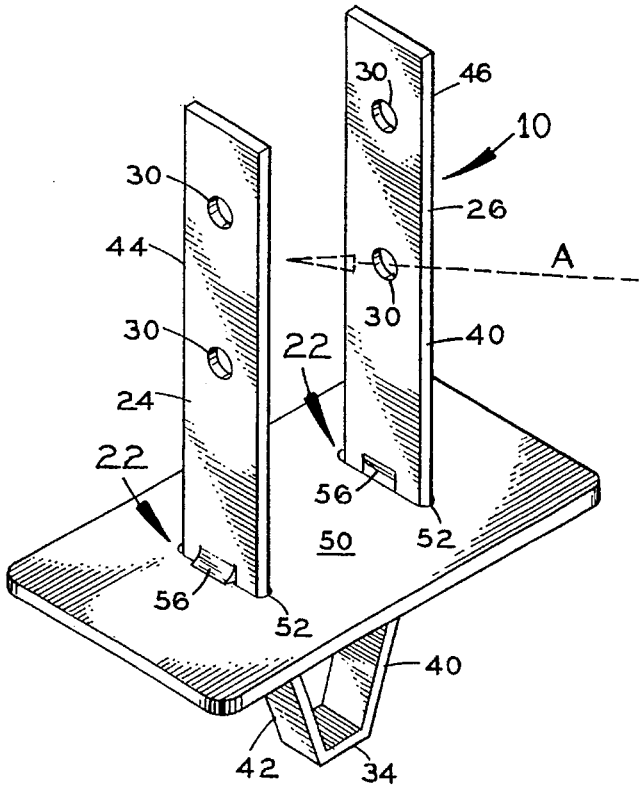
FIG. 1 is a perspective view of the first embodiment of the inventive anchoring apparatus, in its assembled mode.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
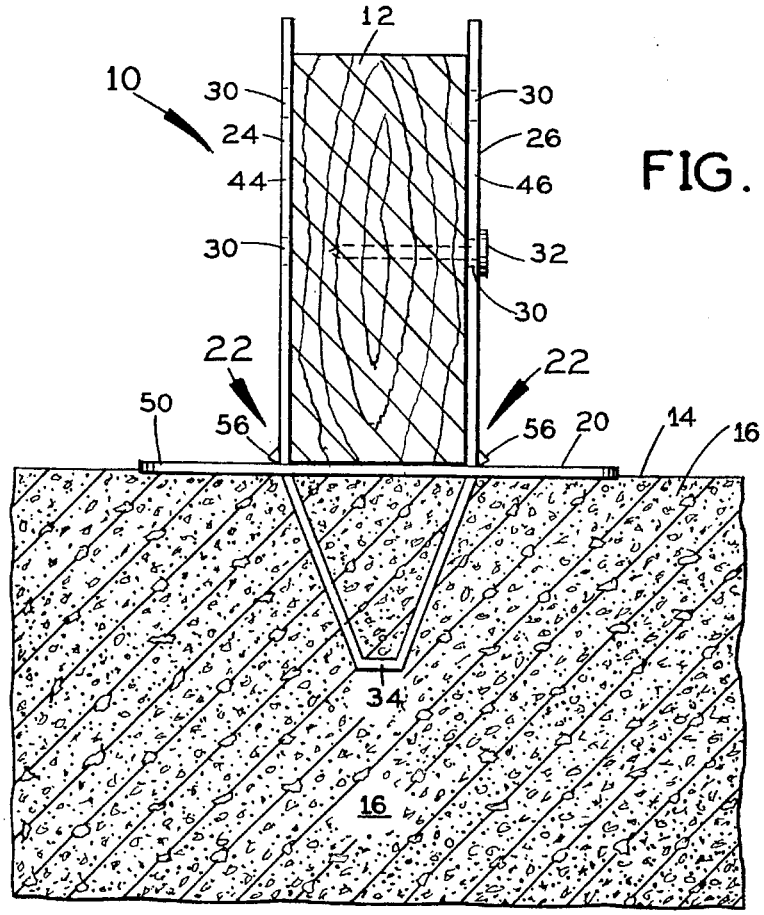
FIG. 2 is a cross-sectional side view of a wall and a truss member joined together by the apparatus of FIG. 1.

Referring to FIGS. 1 and 2, an anchoring apparatus 10 is disclosed for securing a truss member 12 to the top surface 14 of a wall 16. Apparatus 10 includes a wall surface abutment plate 20, abutment plate anchoring means 22 for securing abutment plate 20 to a wall surface 14, and two truss member retaining plates 24 and 26 protruding generally perpendicularly from abutment plate 20 and away from wall surface 14. Retaining plates 24 and 26 are spaced apart from each other an appropriate distance to snugly receive a truss member 12 between them. Retaining plates 24 and 26 include at least one fastener receiving port 30, and preferably include several opposing sets of fastener receiving ports 30. See FIG. 1. A nail or other fastener 32 is inserted through a fastener receiving port 30, into or through the truss member 12, and optionally through a fastener port 30 in the opposing retaining plate 24 or 26.

Abutment plate anchoring means 22 include a substantially U-shaped anchoring plate 34 which extends from the abutment plate 20 opposite retaining plates 24 and 26. Anchoring plate 34 is embedded in the wall 16 when wall 16 is formed, such as of concrete.

A key inventive aspect of apparatus 10 is the way it is formed from two parts which are easy to manufacture and compact to store separately. For the first embodiment, the first part is a U-shaped member 40 which takes the form of an elongate plate doubled over at its center into a tight curved portion 42 with long leg portions 44 and 46. Curved portion 42 constitutes the U-shaped anchoring plate 34 and leg portions 44 and 46 constitute retaining plates 24 and 26. The second part is a separate abutment plate 50 which includes a pair of spaced apart, parallel slots 52.

When apparatus 10 is to be used, leg portions 44 and 46 of U-shaped member 40 are fitted through the parallel slots 52 until they protrude through abutment plate 50 to the full retaining plate length. Tabs 56 are cut and bent out of U-shaped member 40 and oriented generally toward the curved portion 42 to engage abutment plate 20. Abutment plate slots 52 ride along leg portions 44 and 46, and over tabs 56, and tabs 56 block abutment plate 50 against moving back along leg portions 44 and 46.

Second Preferred Embodiment

Figure 3:
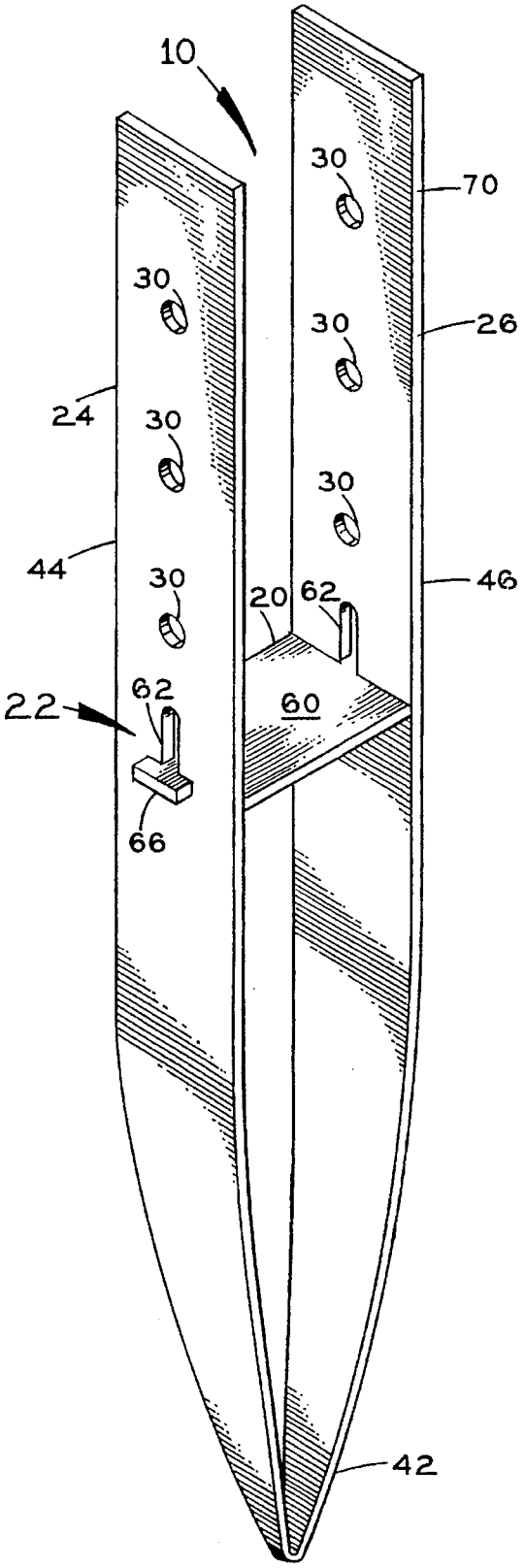
FIG. 3 is perspective view of the second embodiment of the apparatus in its assembled mode.
Figure 5:
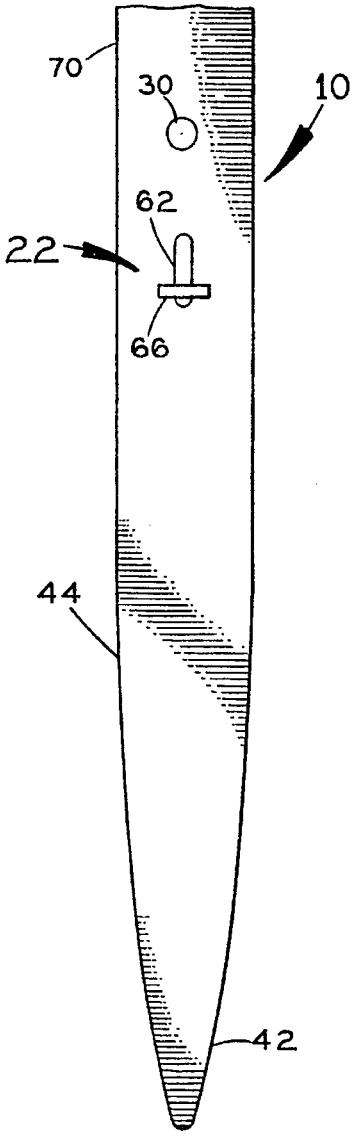
FIG. 5 is a side view the apparatus of the second embodiment, showing how a T-portion of the abutment plate engages a slot in the U-shaped member.
Figure 4:
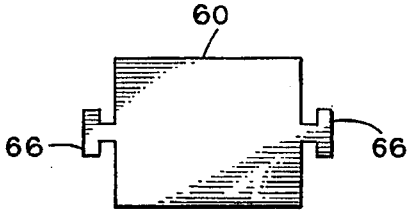
FIG. 4 is a top view of the abutment plate of the second embodiment, showing the preferred T-portions for engaging the U-shaped member.

The second embodiment of apparatus 10 is generally like the first except that leg portion slots 62 rather than tabs are cut into leg portions 44 and 46. Slots 62 are oriented longitudinally in relation to leg portions 44 and 46 and are positioned to directly oppose each other. See FIGS. 3–5. Abutment plate 60 is sized from end to end to fit between leg portions 44 and 46, except that slot engaging T-portions 66 protrude from opposing ends of abutment plate 60. U-shaped member 70 is sufficiently flexible and resilient that leg portions 44 and 46 may be pulled apart to clear T-portions 66. T-portions 66 are then fitted through the corresponding leg portion slots 62 and abutment plate 60 is rotated one quarter turn relative to U-shaped member 70 to lock into engagement with U-shaped member 70.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An anchoring apparatus for securing a truss member to a concrete structural member, comprising:

a substantially U-shaped member including an elongate plate bent end to end in the form of a curved portion and two leg portions, each said leg portion including an abutment plate engaging slot, an abutment plate sized to fit between said leg portions and including two abutment plate ends, each said abutment plate end including leg portion engaging means for anchoring said abutment plate to said U-shaped member, said leg portion engaging means comprise said abutment plate engaging slot in each leg portion and a substantially T-shaped protrusion at each said abutment plate end for insertion into said engaging slots, such that rotating said abutment plate relative to said leg portions interlocks said U-shaped member and said abutment plate.

2. An apparatus according to claim 1, wherein said engaging slots are oriented longitudinally in relation to said leg portions and positioned to directly oppose each other.

* * * * *